US006247294B1

(12) United States Patent
Suolahti

(10) Patent No.: US 6,247,294 B1
(45) Date of Patent: Jun. 19, 2001

(54) WRAPPING APPARATUS

(75) Inventor: Yrjo Suolahti, Mynamaki (FI)

(73) Assignee: OY M. Haloila AB, Masku (FI)

( * ) Notice: Subject to any disclaimer, the term of this patent is extended or adjusted under 35 U.S.C. 154(b) by 0 days.

(21) Appl. No.: 09/458,081

(22) Filed: Dec. 10, 1999

(30) Foreign Application Priority Data

Dec. 11, 1998 (FI) ..... 982693

(51) Int. Cl.[7] ..... B65B 11/06; B65B 11/38; B65B 13/10; B65B 13/16

(52) U.S. Cl. ..... 53/588; 53/176; 53/210; 53/399; 53/441; 53/556; 53/586; 100/27

(58) Field of Search ..... 53/176, 210, 211, 53/399, 441, 465, 556, 586, 587, 588; 100/27, 28

(56) References Cited

U.S. PATENT DOCUMENTS 4,676,048 * 6/1987 Lancaster et al. ..... 53/399
4,712,354 * 12/1987 Lancaster et al. ..... 53/399
5,012,631 * 5/1991 Hostetler et al. ..... 53/588
5,282,347 2/1994 Cleine et al. ..... 53/204
5,311,725 * 5/1994 Martin et al. ..... 53/556
5,850,726 * 12/1998 Degrasse et al. ..... 53/588
5,873,214 * 2/1999 Moore et al. ..... 53/399

* cited by examiner

*Primary Examiner*—Stephen F. Gerrity
*Assistant Examiner*—Hemant M. Desai
(74) *Attorney, Agent, or Firm*—Lowe, Hauptman Gilman & Berner, LLP

(57) ABSTRACT

Wrapping apparatus for winding a web of wrapping foil (F) around an object (1). The wrapping apparatus comprises a ring guideway (2) defining a track of variable curvature and foil dispenser (6). The foil dispenser is provided with idler assemblies (10, 11) supporting the foil dispenser as it moves along the ring guideway. In the idler assembly, an inner idler (12) mounted with bearings on the foil dispenser frame (7) leans by its circumference on an inner rolling surface (3) of the guideway (2). A first outer idler (3) leans by its circumference on an outer rolling surface (4). A lateral idler (14) leans on a lateral rolling surface (5). The idler assembly comprises a second outer idler (15), which leans on the outer rolling surface (4) at a distance from the first outer idler (13). A pivoted frame (16) is mounted with bearings on the frame so that it can turn about a swing axis co-incident with the axis of rotation of the inner idler (12). The first outer idler (13), the second outer idler (15) and the lateral idler (14) are mounted with bearings on the pivoted frame (16).

7 Claims, 4 Drawing Sheets

WRAPPING APPARATUS

SUMMARY OF THE INVENTION

The present invention relates to a wrapping apparatus.

In prior art, a wrapping apparatus for winding a web of wrapping foil around an object is known which comprises a ring guideway forming an endless ring-like track with variable radius and differing from a circular track. The ring guideway comprises an inner rolling surface facing towards the inside of the ring, an outer rolling surface facing outward in a direction opposite to the facing direction of the inner surface, and a lateral rolling surface extending between the inner and outer rolling surfaces.

Moreover, this prior-art wrapping apparatus comprises a foil dispenser, which comprises a frame provided with supporting elements for supporting a foil roll on the frame. On either side of the frame, the foil dispenser has two idler assemblies, disposed at a distance from each other and supporting the foil dispenser as it moves, guided by the ring guideway. The idler assembly comprises an inner idler mounted with a bearing on the frame of the foil dispenser and leaning by its circumference on the inner rolling surface of the guideway. The idler assembly further comprises a first outer idler supported with a bearing on the frame of the foil dispenser on the other side of the guideway in relation to the location of the inner idler. The axis of rotation of the first outer idler is parallel to the axis of rotation of the inner idler, and it leans by its circumference on the outer rolling surface of the guideway. Furthermore, the idler assembly comprises a lateral idler, which is also supported by a bearing on the frame of the foil dispenser and whose axis of rotation is substantially perpendicular to the axes of rotation of the inner and outer idlers. The lateral idler leans by its circumference on the lateral rolling surface of the guideway. Thus, the idler assembly supports the foil dispenser in a direction perpendicular to the guideway, in other words, in all directions except the direction of advance defined by the guideway.

A problem with this prior-art wrapping apparatus is that the lateral idlers tend to wear out fast, so their service life is short. This is because the lateral idlers are mounted on axles fixedly attached to the frame of the foil dispenser so that they are always rolling in a given unchanged direction without adaptation to the changing curvature of the lateral rolling surface. In other words, the plane of rotation of the lateral idler forms a drift angle with the lateral rolling surface, causing wear of the lateral idler.

The object of the invention is to eliminate the drawbacks referred to above.

A specific object of the invention is to disclose an arrangement designed to obviate the problems resulting from the wear of the lateral idler and prolong it service life.

According to the invention, the idler assembly comprises a second outer idler whose axis of rotation is parallel to the axis of rotation of a first outer idler, said second outer idler leaning by its circumference on an outer rolling surface at a distance from the first outer idler. Furthermore the idler assembly comprises a pivoted frame mounted with a bearing on the frame so as to permit it to turn about a swing axis coincident with the axis of rotation of the inner idler, the first outer idler, the second outer idler and the lateral idler being supported with bearings on said pivoted frame.

The advantage provided by the arrangement of the invention is that, as the foil dispenser, guided by a ring guideway, is moving along a track with variable curvature, the axis of rotation of the lateral idler turns substantially in the direction of the radius of the track at every point of the track. The rolling direction of the lateral idler thus follows the direction of a tangent to the curvature of the lateral rolling surface, without forming a drift angle with the lateral rolling surface, with the result that the durability of the lateral idler is improved.

In an embodiment of the wrapping apparatus, the ring guideway comprises two flange parts extending in opposite directions, a first flange part and a second flange part, whose free edge zones form the afore-said rolling surfaces while the lateral rolling surfaces of the flange parts face in directions opposite to each other. For each guide roller assembly engaging the first flange part, the foil dispenser comprises a corresponding similar mirror-image-like guide roller assembly aligned directly oppositely, engaging the second flange part on the opposite side of the ring guideway.

In an embodiment of the wrapping apparatus, the idler assemblies comprise a first idler assembly, which is a leading idler assembly relative to the direction of motion of the foil dispenser, and a second idler assembly, which is a trailing idler assembly running behind the first idler assembly. The first idler assembly is provided with a pivoted frame as mentioned above, the first outer idler, the second outer idler and the lateral idler being supported with bearings on the pivoted frame.

In an embodiment of the wrapping apparatus, the second idler assembly is provided with a pivoted frame as mentioned above, the outer idler, the second outer idler and the lateral idler being supported with bearings on the pivoted frame.

In an embodiment of the wrapping apparatus, the foil dispenser comprises a draw-spring fitted to act between the first idler assembly and the second idler assembly so as to turn them towards each other.

In an embodiment of the wrapping apparatus, the track formed by the ring guideway is disposed in a substantially vertical plane.

In an embodiment of the wrapping apparatus, the object to be wrapped is a cylindrical body provided with a central hole, such as a roll of band or the like. The ring guideway forms a ring-like track of oval shape comprising a straight track portion that passes through the hole in the object to be wrapped and a curved track portion that bends around the object between the ends of the straight track portion.

BRIEF DESCRIPTION OF THE DRAWINGS

In the following, the invention will be described in detail by the aid of a few examples of its embodiments with reference to the attached drawing, wherein.

DETAILED DESCRIPTION

Figure 1:
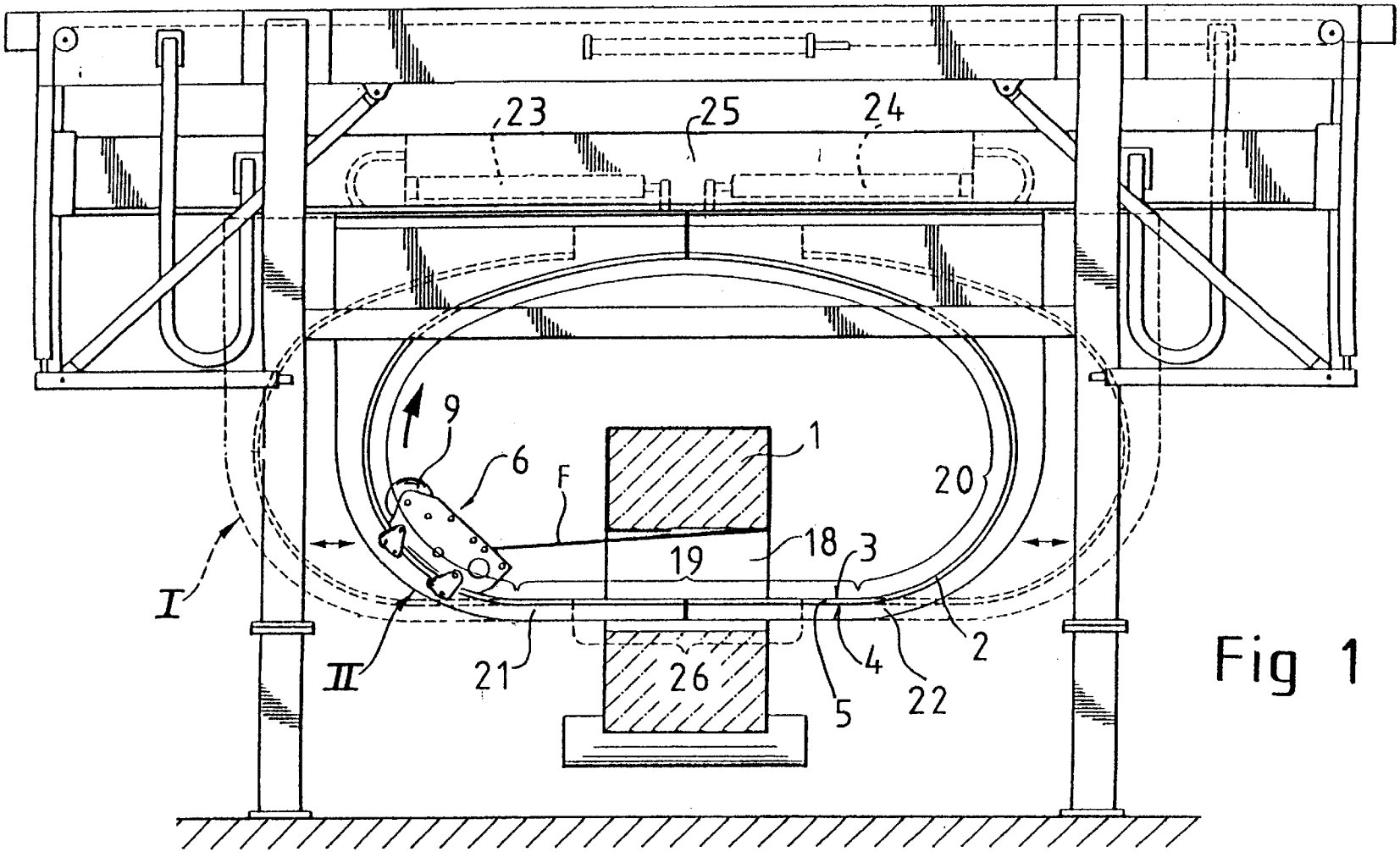
FIG. 1 presents a diagrammatic side view of a first embodiment of the wrapping apparatus of the invention.

FIG. 1 presents a wrapping apparatus designed for the wrapping of rolls of band, e.g. steel band. The band roll 1 rests on a turning gear, e.g. on a support provided with two turning rollers, so that the band roll can be turned about its horizontal longitudinal axis, i.e. about its central axis, during the wrapping operation. The band roll is of a cylindrical shape with a central hole 18 going through it. During wrapping, the band roll 1 is turned slowly by means of the turning gear while at the same time wrapping foil F is being wound around the band roll with a wrapping motion going through the hole 18 so that the wrapping foil does not cover the hole.

To allow a web of wrapping foil F to be wound around an object 1, the wrapping apparatus comprises a ring guideway 2 of a shape resembling an ellipse flattened on one side. The ring guideway 2 is of a variable-radius design, i.e. its shape differs from a circular track. In this example, the curvature of the ring guideway changes at different points of the track because the ring guideway 2 has been arranged to run through the central hole in the roll 1 in the direction of its longitudinal axis along a straight portion 19 of the track, where the track radius is infinite. Between the ends of the straight track portion 19 there is a curved track portion 20 of variable radius, where the radius increases and decreases. Together, the straight track portion 19 and the curved track portion 20 of the ring guideway 2 form an endless ring-like track. The track formed by the ring guideway 2 is disposed in a vertical plane.

The ring guideway 2 consists of two guideway sections 21 and 22, which, using power means 23, 24, can be moved horizontally towards each other and away from each other between two positions I and II. For this reason, the guideway sections 21 and 22 are suspended on a horizontal guide bar 25. In the open position I, depicted in FIG. 1 with broken lines, a gate opening 26 is formed between the guideway sections 21, 22. In the open position I, a band roll 1 can be brought into the wrapping station. In the closed position II, the gate opening is closed and the ring guideway 2 forms a closed ring-like track as mentioned above, going through the hole 18 in the band roll 1.

As can be seen from FIGS. 1–4, the ring guideway 2 is a T-shaped rail in which the cross-sectional form of the horizontal flange of the T is the form of a flat rectangle. The upright part of the T connects the horizontal flange to the frame of the ring guideway. The horizontal T-flange of the ring guideway 2 comprises an inner rolling surface 3, which faces toward the inside of the ring track. Further, the ring guideway comprises an outer rolling surface 4 facing in a direction opposite to the facing direction of the inner rolling surface 3. The outer rolling surface 4 is parallel to the inner rolling surface 3. As the elliptical track is disposed in a vertical plane, the cross-section of the inner and outer rolling surfaces is horizontal. The lateral rolling surface 5 extends vertically between the inner and outer rolling surfaces.

As shown in FIG. 1, the wrapping apparatus comprises a foil dispenser 6, which is mounted on the ring guideway 2 so that it can move along a path defined by the ring guideway 2 around the band roll 1 and through the hole 18. The foil dispenser 6 comprises a frame 7 with supporting elements 8 (not shown in the figure), by means of which the foil roll 9 can be detachably mounted on the frame 7. Furthermore, the foil dispenser 6 comprises tensioning means for maintaining a suitable foil tension.

On both sides of the foil dispenser 6 there are two idler assemblies 10, 11 disposed at a distance from each other in the direction of the ring guideway 2, supporting the foil dispenser 6 as it moves along the ring guideway 2.

As shown in FIGS. 2–5, each idler assembly 10, 11 comprises an inner idler 12 supported by a bearing on the frame 7 and leaning by its circumference on the inner rolling surface 3 of the ring guideway 2.

The first outer idler 13, whose axis of rotation is parallel to the axis of rotation of the inner idler 12, leans by its circumference on the outer rolling surface 4 of the ring guideway. The first outer idler 13 is supported by a bearing on the pivoted frame 16, which again is supported by a bearing on the frame 7 of the foil dispenser 6. The pivoted frame 16 turns about a swing axis coincident with the axis of rotation of the inner idler 12.

Mounted with a bearing on the pivoted frame 16 is also a second outer idler 15. The axis of rotation of the second outer idler 15 is parallel to the axis of rotation of the first outer idler 13 and disposed at a distance from it, so the second outer idler 15 leans by its circumference on the outer rolling surface 4 at a distance from the first outer idler 13.

The lateral idler 14, whose axis of rotation is substantially perpendicular to the axes of rotation of the inner idler 12 and outer idler 13 and which lateral idler leans by its circumference on the lateral rolling surface 5, is also supported by a bearing on the pivoted frame 16.

As the foil dispenser 6, guided by the ring guideway 2, is moving along the outer rolling surface 4, the outer idlers 13 and 15 cause the pivoted frame 16 to turn about is swing axis in accordance with the form of the track so that the axis of rotation of the lateral idler 14 connected to the pivoted frame 16 turns at every point of the track in the direction of the track radius. In other words, at all points of the track, the middle plane of rotation of the lateral idler 14 is oriented in the direction of a tangent to the track. Thus, a zero drift angle of the lateral idler 14 with respect to the lateral rolling surface 5 is achieved and no attrition appears between the lateral idler 14 and the lateral rolling surface 5.

Figure 2:
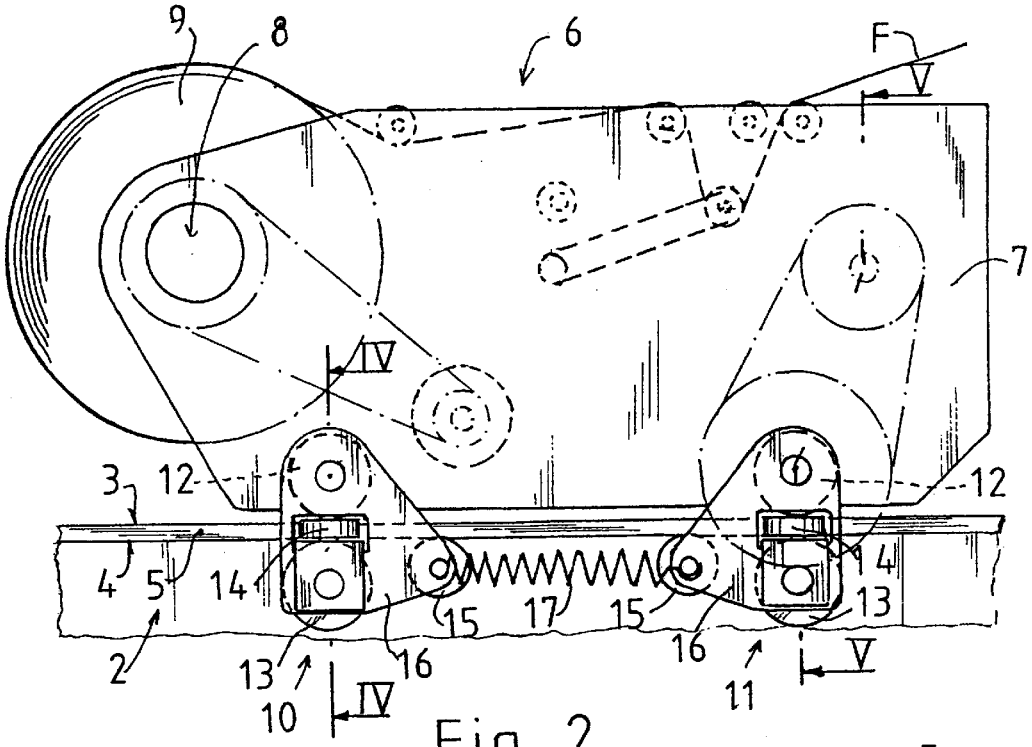
FIG. 2 presents a foil dispenser comprised in the wrapping apparatus in FIG. 1 on a straight portion of a ring guideway.
Figure 3:
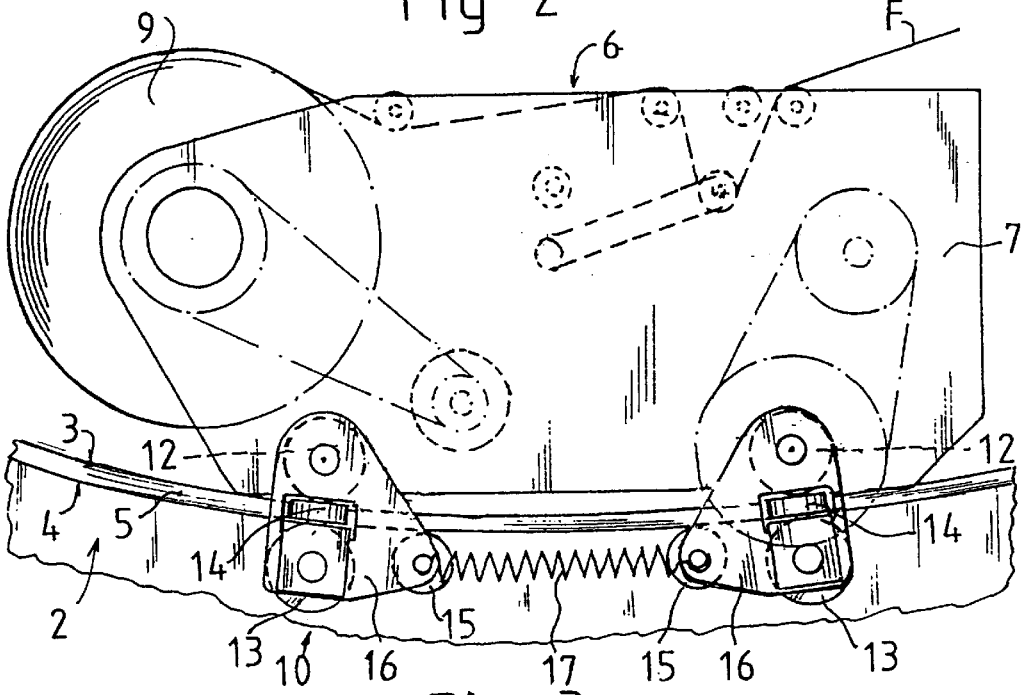
FIG. 3 presents the foil dispenser in FIG. 2 on a curved portion of the ring guideway.
Figure 4:
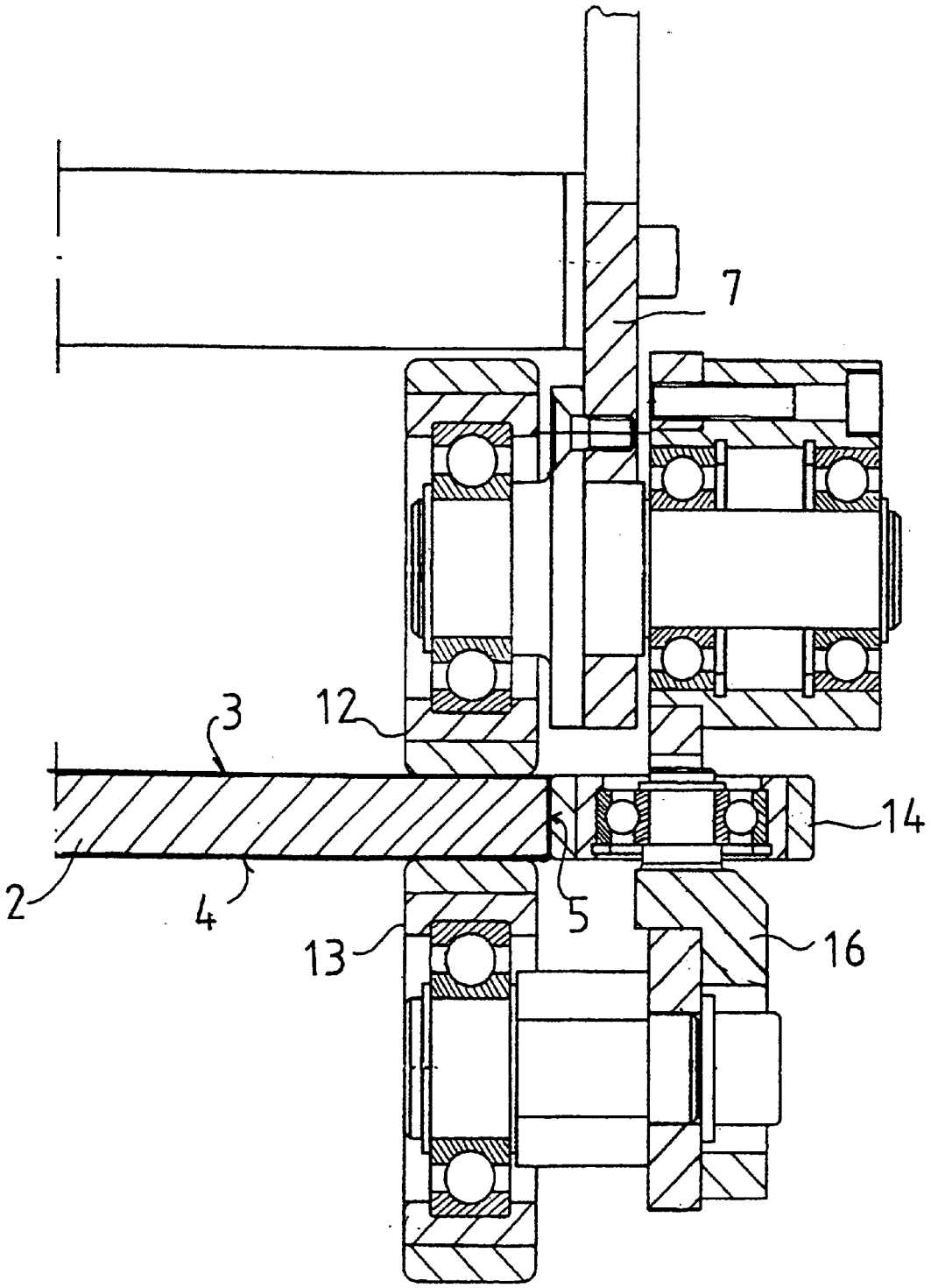
FIG. 4 presents section IV—IV taken of FIG. 2.

As can be seen from FIGS. 2 and 3, the inner idler and the outer idlers are disposed in a triangular configuration relative to each other. The inner idler 12 is located directly oppositely to the first outer idler 13 on the opposite side of the guideway 2. The axis of rotation of the lateral idler 14 lies in the same plane (perpendicular to the plane of the drawing) with the axes of rotation of the inner idler 12 and the first outer idler 13. The second outer idler 15 is disposed at some distance to one side of the above-mentioned plane. Both the leading idler assembly 10 and the trailing idler assembly 11 are preferably designed to be turnable in a corresponding manner. As shown in the figures, the idler assemblies 10, 11 can be connected with a draw-spring 17 to each other or to the frame 7 of the foil dispenser 6.

Figure 5:
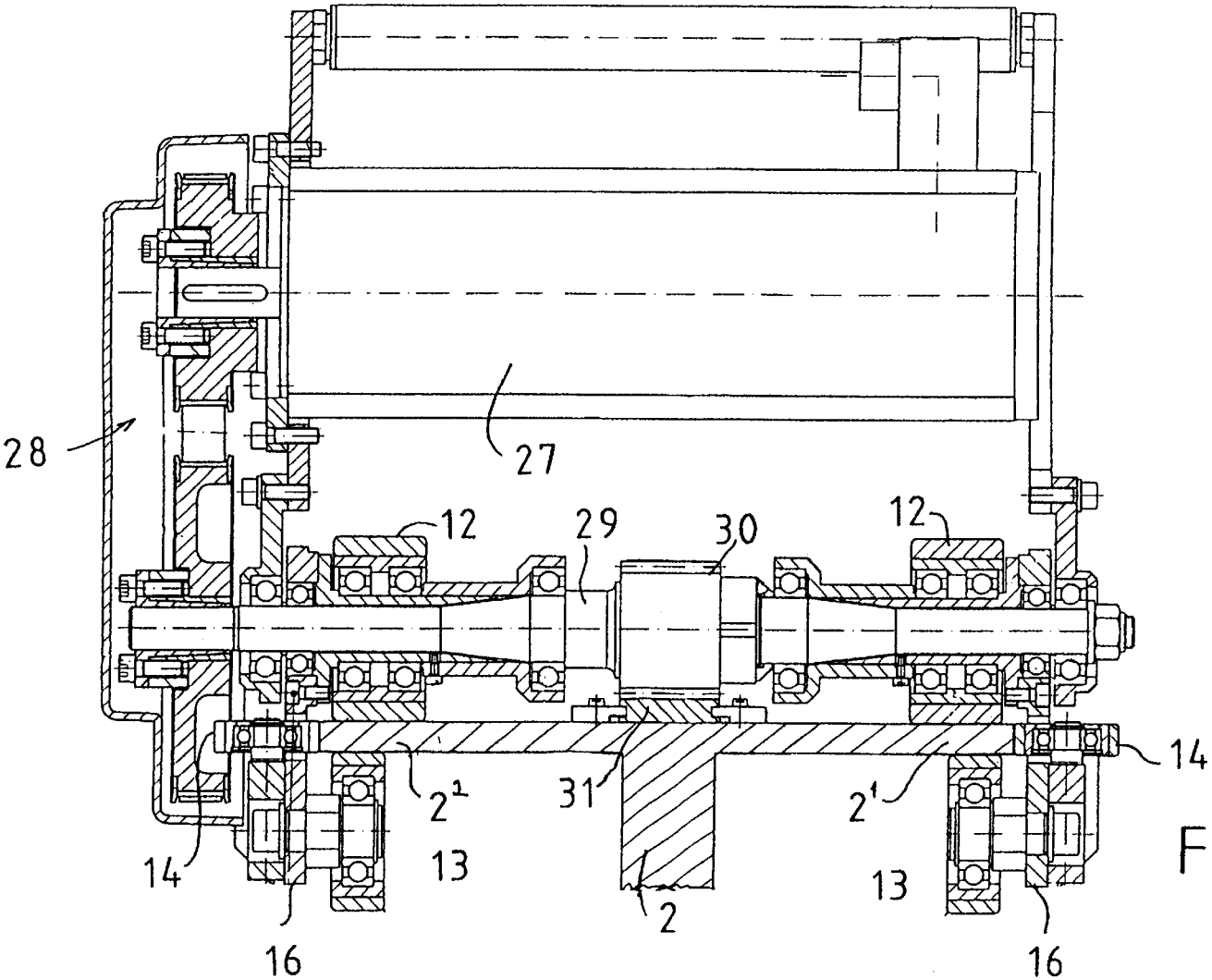
FIG. 5 presents section V—V taken of FIG. 2.

As can be seen from the diagrammatic section presented in FIG. 5, the ring guideway 2 comprises two flange parts extending in opposite directions, a first flange part $2^1$ and a second flange part $2^2$. The free edge areas of these flange parts constitute the above-mentioned rolling surfaces, the lateral rolling surfaces 5 facing in opposite directions away from each other. For each guide roller assembly engaging the first flange part $2^1$, the foil dispenser 6 comprises a corresponding mirror-image-like guide roller assembly of similar construction engaging the second flange part $2^2$ placed directly oppositely on the other side of the ring guideway.

FIG. 5 also shows the drive mechanism and power transmission arrangement used in the foil dispenser 6. The foil dispenser 6 comprises a drive motor 27 which, via a belt transmission 28, drives a drive shaft 29 provided with a toothed gear 30, which again is in driving engagement with a toothed rack 31 fixed to the ring guideway 2. The pivoted frame 16 and inner idler 12 of the second idler assembly 11 are mounted with bearings on the drive shaft 29 in a manner permitting free rotation.

The invention is not restricted to the examples of its embodiments described above, but many variations are possible within the scope of the inventive idea defined in the claims.

What is claimed is:

1. Wrapping apparatus for winding a web of wrapping foil (F) around an object (1), said wrapping apparatus comprising a ring guideway (2) forming a track with variable radius and comprising an inner rolling surface (3) facing towards the inside of the ring, an outer rolling surface (4) facing outward in a direction opposite to the inner rolling surface, and a lateral rolling surface (5) extending between the inner and outer rolling surfaces; and a foil dispenser (6), which comprises a frame (7) provided with supporting elements (8) for supporting a foil roll (9) on the frame and at least two idler assemblies (10, 11) disposed at a distance from each other in the direction of the ring guideway (2) and supporting the foil dispenser as said foil dispenser moves guided by the ring guideway, each of said idler assemblies comprising an inner idler (12) mounted with a bearing on the frame (7) and leaning by its circumference on the inner rolling surface (3), a first outer idler (13), whose axis of rotation is parallel to the axis of rotation of the inner idler and said lateral idler leans by its circumference on the outer rolling surface (4), and a lateral idler (14), whose axis of rotation is substantially perpendicular to the axes of rotation of the inner and outer idlers and said lateral idler leans by its circumference on the lateral rolling surface (5), wherein the idler assembly comprises a second outer idler (15), whose axis of rotation is parallel to the axis of rotation of the first outer idler (13) and said second outer idler leans by its circumference on the outer rolling surface (4) at a distance from the first outer idler (13); and a pivoted frame (16) mounted with a bearing on the frame so as to permit the pivoted frame to turn about a swing axis coincident with the axis of rotation of the inner idler (12), the first outer idler (13), the second outer idler (15) and the lateral idler (14) being supported with bearings on said pivoted frame, so that as the foil dispenser, guided by the ring guideway, is moving along a track with variable curvature, the axis of rotation of the lateral idler turns substantially in the direction of the radius of the track at every point of the track.

2. Wrapping apparatus as defined in claim 1, wherein the ring guideway (2) comprises two flange parts extending in opposite directions, a first flange part ($2^1$) and a second flange part ($2^2$), whose free edge zones form the aforesaid rolling surfaces while the lateral rolling surfaces (5) of the flange parts face in directions opposite to each other; and that for each guide roller assembly engaging the first flange part ($2^1$), the foil dispenser (6) comprises a corresponding aligned similar mirror-image-like guide roller assembly engaging the second flange part ($2^2$) on the opposite side of the ring guideway.

3. Wrapping apparatus as defined in claim 1, wherein the idler assemblies comprise a first idler assembly (10), said first idler assembly is a leading idler assembly relative to the direction of motion of the foil dispenser, and a second idler assembly (11), said second idler assembly is a trailing idler assembly running behind the first idler assembly; and that the first idler assembly (10) is provided with the pivoted frame (16), the first outer idler (13), the second idler (15) and the lateral idler (14) being supported with bearings on said pivoted frame.

4. Wrapping apparatus as defined in claim 3, wherein the second idler assembly (11) is provided with the pivoted frame (16), the outer idler (13), the second outer idler (15) and the lateral idler (14) being supported with bearings on said pivoted frame.

5. Wrapping apparatus as defined in claim 3, wherein the foil dispenser comprises a draw-spring (17) fitted to act between the first idler assembly (10) and the second idler assembly (11) so as to turn them towards each other.

6. Wrapping apparatus as defined in claim 1, wherein the track formed by the ring guideway (2) is disposed in a substantially vertical plane.

7. Wrapping apparatus as defined in claim 1, wherein the object (1) to be wrapped is a cylindrical body provided with a central hole (18), and that the ring guideway (2) forms a ring-like track of oval shape comprising a straight track portion (19) that passes through the hole (18) in the object (1) to be wrapped and a curved track portion (20) that bends around the object between the ends of the straight track portion.

* * * * *